US005406903A

United States Patent [19]

Clark

[11] Patent Number: 5,406,903

[45] Date of Patent: Apr. 18, 1995

[54] STABILIZING JACKET FOR A TOWED CABLE OR ANTENNA STRUCTURE

[75] Inventor: James H. Clark, Lyme, N.H.

[73] Assignee: The United States of America as represented by the Secretary of the Navy, Washington, D.C.

[21] Appl. No.: 286,590

[22] Filed: Aug. 8, 1994

[51] Int. Cl.[6] ..... F15D 1/10

[52] U.S. Cl. ..... 114/243

[58] Field of Search ..... 114/243, 242, 253

[56] References Cited

U.S. PATENT DOCUMENTS 3,137,264 6/1964 Brainard, II et al. ..... 114/243
3,498,246 3/1970 Kiefer ..... 441/133
4,252,074 2/1981 Blaisdell ..... 114/243

*Primary Examiner*—Jesûs D. Sotelo
*Attorney, Agent, or Firm*—Michael J. McGowan; Prithvi C. Lall; Michael F. Oglo

[57] ABSTRACT

A stabilizing jacket for a towed cable or antenna structure is operative for preventing rotation of the antenna/cable structure as it is towed through the water. The stabilizing jacket consists of an elongated body having a longitudinal bore extending therethrough for receiving the antenna/cable structure therein. The body may extend along the entire length of the antenna/cable structure and is symmetrical about a vertical median. The body further includes first and second symmetrical deflection vanes which extend outwardly from opposite sides of the body, and first and second symmetrical keel fins which diverge outwardly and downwardly from the body immediately adjacent the median. The deflection vanes and keel fins may extend along an entire length of the body. The symmetrical keel fins effectively increase the metacentric height of the antenna/cable structure and thereby tend to prevent rotation of the antenna/cable structure due to hydrodynamic forces as the antenna/cable is towed through the water.

8 Claims, 1 Drawing Sheet

STABILIZING JACKET FOR A TOWED CABLE OR ANTENNA STRUCTURE

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

The instant invention relates to towing cables or antenna-like structures which are towed in the water from a surface vessel and more particularly to an outer jacket for stabilizing or eliminating rotation of the antenna/cable while in tow.

2. Description of the Prior Art

Antenna or cable stabilizing devices have heretofore been known in the art. In this regard, the U.S. Pat. Nos. to Brainard II, et al, No. 3,137,264; and Blaisdell, No. 4,252,074 represent the closest prior art to the subject invention of which the applicant is aware. The patent to Brainard discloses a fairing for a towed cable comprising a wing-like structure having a symmetrically streamlined cross-section. The fairing is operative for minimizing cable drag and vibration during towing. The patent to Blaisdell discloses lifting bodies for an antenna structure which is towed from a submerged vessel, such as a submarine. The lifting bodies are spaced along the length of the antenna structure wherein they are operative for lifting the antenna structure to the surface to provide radio frequency service.

SUMMARY OF THE INVENTION

It is an object of the instant invention to provide a stabilizing jacket for a towing cable or antenna structure which prevents rotation of the antenna/cable while being towed from a surface vessel.

It is another object to provide a stabilizing device which is formed as part of the outer housing of the antenna/cable structure.

When an antenna or cable is towed on top of the water, or immediately below the water surface, by a vessel, it is subject to many different hydrodynamic forces which tend to cause the antenna/cable to rotate or twist. Depending on the device being towed, the antenna/cable may contain fiber optic cables or other sensitive electronic cables which transmit electronic signals back to the towing vessel. Rotation of the antenna/cable while in tow subjects the internal cables to significant torque forces which may ultimately damage the internal cables. Accordingly, it is important to prevent any rotation of a cable or antenna while in tow.

The instant invention provides a stabilizing jacket for a towed antenna structure or towing cable which is operative for preventing rotation of the antenna/cable as it is towed through the water. The stabilizing jacket consists of an elongated, extruded, plastic body having a longitudinal bore extending therethrough for receiving the antenna/cable structure therein. The body extends along the entire length of the antenna/cable structure and it is symmetrical about a vertical median. The body includes first and second symmetrical deflection vanes which extend perpendicularly outwardly from opposite sides of the body, and first and second symmetrical keel fins which diverge outwardly and downwardly from the body immediately adjacent the median. The deflection vanes and keel fins may extend along the entire length of the extruded body. The symmetrical keel fins extend below the surface of the water and effectively increase the metacentric height of the antenna/cable thereby tending to prevent rotation of the antenna/cable due to hydrodynamic forces as the antenna/cable is towed through the water.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawing wherein.

DESCRIPTION OF THE PREFERRED EMBODIMENT

Figure 1:
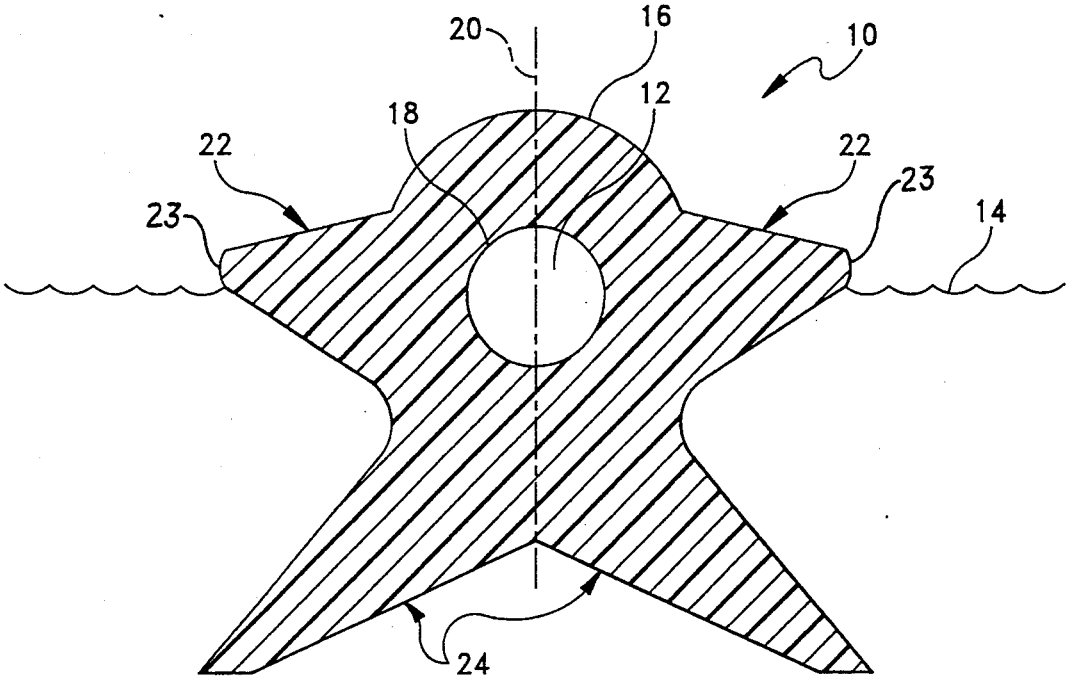
FIG. 1 is a cross-sectional view of the stabilizing jacket of the instant invention.

Referring now to the drawing, the stabilizing jacket of the instant invention is illustrated and generally indicated at 10 in FIG. 1. As will hereinafter be more fully described, stabilizing jacket 10 is operative for reducing or preventing rotation of a towed antenna/cable structure 12, such as a towing cable or antenna, as it is towed through the water 14.

Stabilizing jacket 10 comprises an elongated generally cylindrical body 16 having a longitudinal bore 18 extending therethrough for receiving antenna/cable structure 12 therein. Body 16 preferably extends along the entire length of antenna/cable structure 12 and is symmetrical about a vertical median 20. Body 16 includes first and second symmetrical deflection vanes generally indicated at 22 which extend outwardly from opposite sides of body 16. Deflection vanes 22 are generally triangular in shape and extend outwardly from body 16 substantially perpendicular to median 20. In this connection, the base of the deflection vane 22 is substantially parallel and adjacent to the median 20, and an apex 23 is remote from the median 20. Body 16 further includes first and second symmetrical keel fins 24 which diverge outwardly and downwardly from body 16 immediately adjacent to median 20. Deflection vanes 22 and keel fins 24 preferably extend along the entire length of body 16 to provide maximum stability, but may extend along only a portion of body 16. Jacket 10 essentially serves as an outer housing for antenna/cable structure 12 and in this connection, jacket 10 is preferably extruded over antenna/cable structure 12 as a one-piece entity. Jacket 10 is preferably extruded from a flexible, yet rigid, plastic material, such as polyethylene.

As antenna/cable structure 12 is towed through the water, deflection vanes 22 skim over the surface of water 14, and keel fins 24 extend below the surface of the water. Keel fins 24 effectively increase the metacentric height of antenna/cable structure 12 and thereby tend to prevent rotation of antenna/cable structure 12 due to hydrodynamic forces as antenna/cable structure 12 is towed through the water. While the instant stabilizing jacket 10 is illustrated for use in a partially submerged application, it is to be understood that jacket 10 is equally effective for uses wherein antenna/cable structure 12 is completely submerged under the water 14.

It can therefore be seen that the instant invention provides an effective stabilizing jacket 10 for a towed antenna/cable structure 12. Keel fins 24 of jacket 10 effectively increase the metacentric height of antenna/-cable structure 12 and thus are operative for preventing rotation of antenna/cable structure 12 while in tow. For these reasons, the stabilizing jacket of the instant invention is believed to represent a significant advancement in the art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A stabilizing jacket for a towed cable structure comprising:

an elongated body having a longitudinal bore extending therethrough for receiving said cable structure therein, said body further having a median dividing said body into symmetrical halves;

first and second symmetrical keel fins which diverge outwardly from said body; and first and second symmetrical deflection vanes which extend outwardly from opposite sides of said body.

2. The stabilizing jacket of claim 1, wherein said deflection vanes extend outwardly substantially perpendicular to said median.

3. The stabilizing jacket of claim 2, wherein said deflection vanes have a substantially triangular cross section, said triangular cross section having a base substantially parallel and adjacent to said median and an apex remote from said median.

4. In the stabilizing jacket of claim 2, said body having first and second ends, said keel fins extending along an entire length of said body between said first and second ends.

5. The stabilizing jacket of claim 1 wherein said elongated body has a length equal to a length of said cable structure.

6. In the stabilizing jacket of claim 1, said keel fins diverging outwardly and downwardly from said body immediately adjacent said median.

7. A stabilizing jacket for a towed cable structure, comprising:

an elongated body having first and second ends and a length equal to a length of said cable structure, said body further having a longitudinal bore extending therethrough for receiving said cable structure therein, said body still further having a median dividing said body into symmetrical halves;

first and second symmetrical deflection vanes extending outwardly from opposite sides of said body; and first and second symmetrical keel fins which diverge outwardly and downwardly from said body immediately adjacent said median, said deflection vanes and said keel fins extending along an entire length of said body between said first and second ends thereof.

8. A stabilizing jacket for a towed cable structure, comprising:

an elongated body having first and second ends and a length equal to a length of said cable structure, wherein said body is extruded longitudinally onto said cable structure along said length thereof, said body still further having a median dividing said body into symmetrical halves;

first and second symmetrical deflection vanes extending outwardly from opposite sides of said body; and, first and second symmetrical keel fins which diverge outwardly and downwardly from said body immediately adjacent said median, said deflection and said keel fins extending along an entire length of said body between said first and second ends thereof.

* * * * *